United States Patent [19]

Yunoki

[11] 4,186,863

[45] Feb. 5, 1980

[54] STAPLE FASTENER APPLYING MACHINE

[75] Inventor: Akio Yunoki, Namerikawa, Japan

[73] Assignee: Yoshida Kogyo K.K., Tokyo, Japan

[21] Appl. No.: 885,269

[22] Filed: Mar. 10, 1978

[30] Foreign Application Priority Data

Mar. 25, 1977 [JP] Japan ..... 52-33774

[51] Int. Cl.[2] ..... B25C 1/06

[52] U.S. Cl. ..... 227/131; 227/155

[58] Field of Search ..... 227/95, 96, 120, 125, 227/126, 127, 131, 139, 135, 136, 155

[56] References Cited

U.S. PATENT DOCUMENTS

| | | | |
|---|---|---|---|
| 400,792 | 4/1889 | Remus | 227/95 |
| 2,556,002 | 6/1951 | Sachleben | 227/95 |
| 3,625,408 | 12/1971 | Amakawa et al. | 227/131 |
| 3,666,157 | 5/1972 | Kawai et al. | 227/131 |
| 3,862,712 | 1/1975 | LaPointe et al. | 227/127 |
| 4,030,656 | 6/1977 | Gordon | 227/131 |

*Primary Examiner*—Paul A. Bell

*Attorney, Agent, or Firm*—Bucknam and Archer

[57] ABSTRACT

A staple fastener applying machine comprises a base on which is mounted a first support that pivotally supports a driver arm carrying a driver and a holder arm holding a staple magazine, the driver arm being actuatable for angular movement toward the base by a solenoid mounted on the base so as to force the driver toward a clinching anvil carried on a second support mounted on the base. Staple fasteners stored in the magazine are fed one at a time into the path of movement of the driver for being driven thereby. The solenoid is located remotely from the second support to provide a relatively large space around the second support such that the machine can handle a relatively bulky object for staple applying operation. The driver and holder arms are spring-biased away from each other, but are prevented from moving apart beyond a certain angular spacing between them. The driver arm is spring-biased to pivotally move away from the base, such pivotal movement being limited within a certain angle between the driver arm and the base.

8 Claims, 6 Drawing Figures

STAPLE FASTENER APPLYING MACHINE

BACKGROUND OF THE INVENTION

1. Field of the Invention

The present invention relates to a machine for applying and clinching a staple fastener to and about an object.

2. Prior Art

There have been many stapling machines that are manually electrically, or mechanically powered. Most of the hand-operated machines are portable, but since at least one hand is occupied to actuate them, the machines are not suitable where precision operation is needed frequently.

The power-driven machines are analogous in shape to the punch press and are necessarily large in size. They cannot be easily carried from place to place. Further, such fastener applying machines provide a relatively small space around the clinching anvil, which requires that an object to be stapled be as less bulky as possible for being handled under the punch safely and smoothly.

SUMMARY OF THE INVENTION

According to the invention, a driver arm pivotally supported on a first support mounted on a base is angularly moved by a solenoid mounted on the base to bring the driver toward an anvil supported on a second support mounted on the base, the solenoid being located remotely from the second support to provide a space around the anvil. A holder arm holding a staple magazine is also pivotally supported on the first support, the staples being fed one at a time into guide means on the holder arm and magazine for being driven by the driver toward the anvil. The driver arm and the holder arm are urged to move away from each other by spring means, such movement being confined in an angular spacing therebetween. Damper means resiliently restricts the pivotal movement of the holder arm away from the base.

It is an object of the present invention to provide a staple fastener applying machine which is compact and is relatively light in weight.

Another object of the present invention is to provide a staple fastener applying machine which has a maximum amount of space around a clinching anvil such that stapling operation will be carried out easily and safely.

A still further object of the present invention is to provide a staple fastener applying machine which can handle relatively bulky objects.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
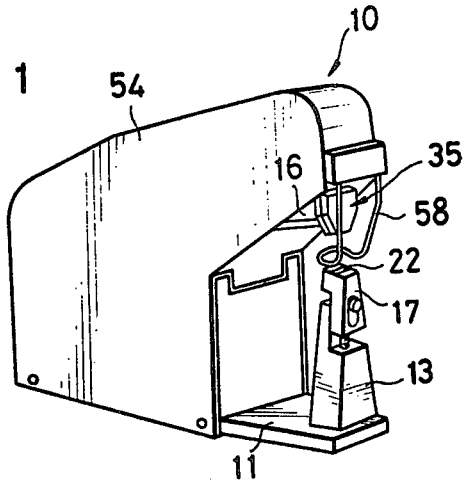
FIG. 1 is a perspective view of a staple fastener applying machine constructed in accordance with the present invention.

The principles of the present invention are particularly useful when embodied in a staple fastener applying machine illustrated in FIG. 1 and generally indicated at 10.

Figure 2:
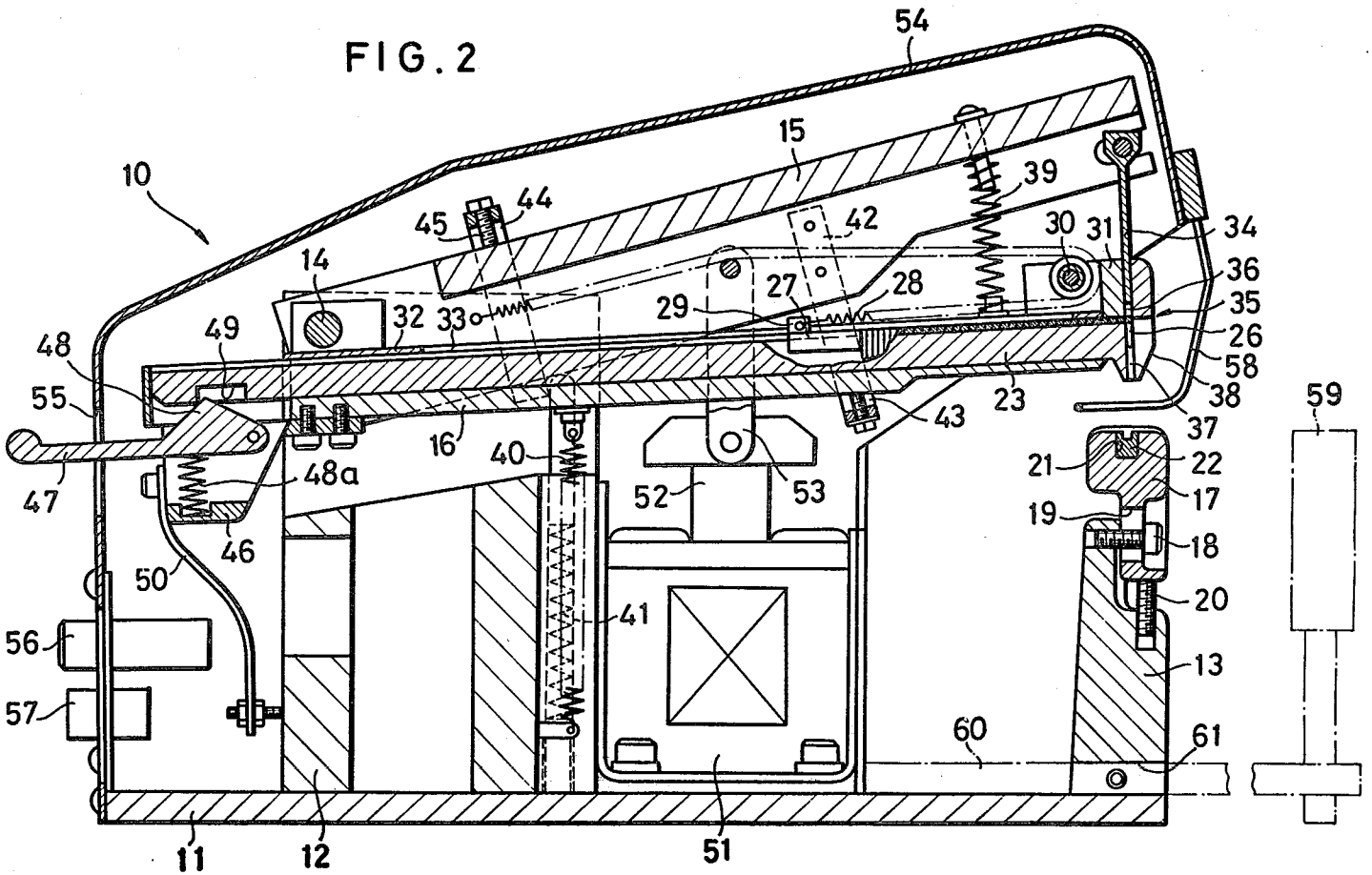
FIG. 2 is an enlarged vertical cross-sectional view of the machine of FIG. 1 with portions shown in elevation.

As best shown in FIG. 2, the machine 10 comprises a base 11 on which are mounted a first upstanding support 12 and a second upstanding support 13 that are spaced from each other. The first support 12 has a horizontal pin 14 near its upper end, the pin 14 supporting a driver arm 15 and a holder arm 16 at their one or rear ends, the holder arm 16 being positioned beneath the driver arm 15. The driver arm 15 and the holder arm 16 are angularly movable or pivotable about the pin 14, independently of each other within a certain angular spacing between them, as described below.

Figure 3:
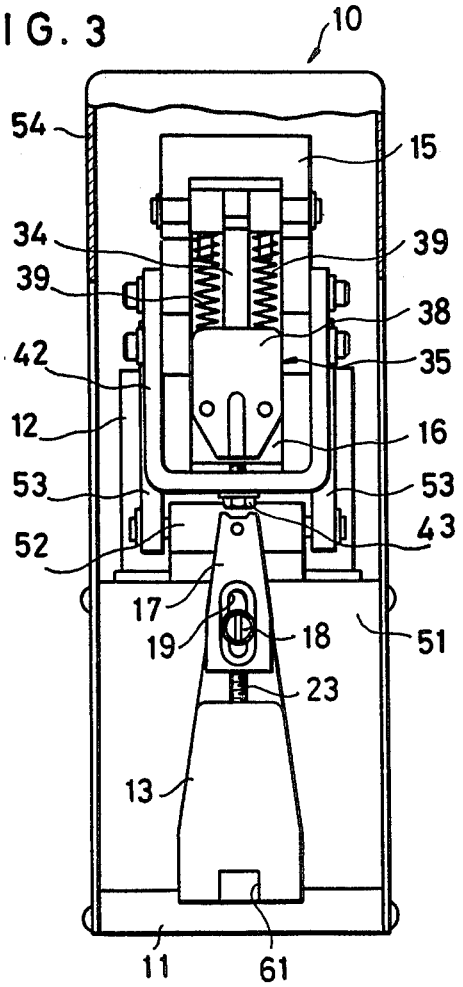
FIG. 3, appearing with FIG. 1, is a front elevational view, with parts broken away, of the machine.

The second support 13 supports thereon an anvil holder 17 which is fixed to the second support 13 by means of a machine screw 18 extending threadedly into the second support 13 horizontally through a vertical slot 19 (better shown in FIG. 3) in the anvil holder 17. Thus the anvil holder 17 is vertically adjustable in position relative to the second support 13. The second support 13 also carries a vertical machine screw 20 on which the anvil holder 17 rests for positional stability upon adjustment. The anvil holder 17 has a recess 21 in its top surface, in which a clinching anvil 22 is inserted with its anvil groove facing upwardly.

Figure 4:
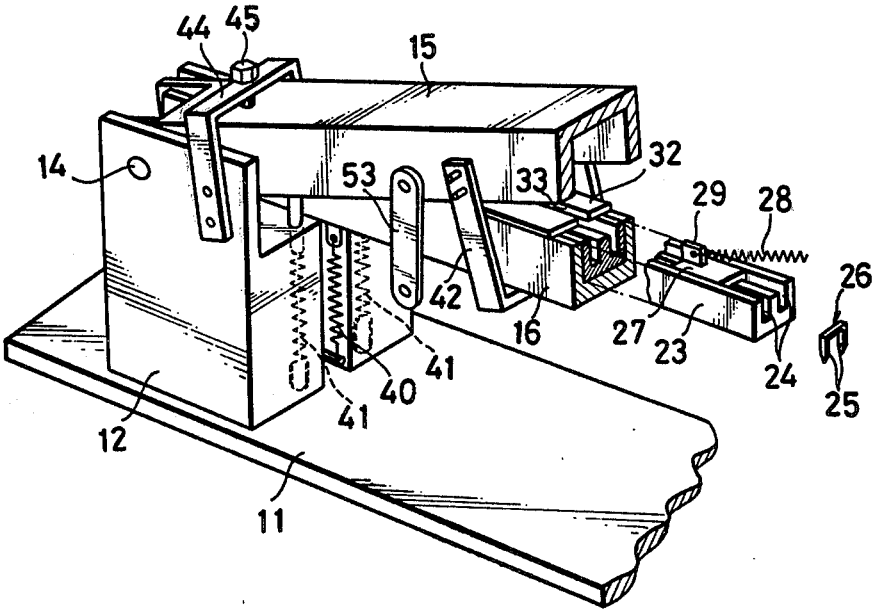
FIG. 4 is a fragmentary perspective view showing a relationship of coaction between a driver arm and a holder arm of the machine.

As illustrated in FIG. 4, the driver arm 15 is of a channel-shaped cross section with the channel opening directed downwardly, and the holder arm 16 is similarly of a channel-shaped cross section with the channel opening directed upwardly. Upon pivotal downward movement, the driver arm 15 fits over the holder arm 16. Fitted in the holder arm 16 is a staple magazine 23 that is longitudinally slidable for removal from or insertion into the holder arm 16, the magazine 23 having a pair of longitudinal slots 24,24 in which the legs 25,25 of a row of staple fasteners 26 can be disposed. A staple feeder 27 slidably mounted in the magazine 23 has a pair of legs disposed respectively in the slots 24,24 in the magazine 23 and is urged therealong by a tension spring 28 so as to force the loaded staple fasteners 26 out of the magazine 23. The tension spring 28 is attached at its one end to a lug 29 on the staple feeder 27, and as shown in FIG. 2 extends around a roller 30 on a bracket 31 fixed to the holder arm 16 at its front end, and is attached at the other end to the punch arm 15. A cover plate 32 is placed over the holder arm 16 to cover the magazine 23, the cover plate 32 having a longitudinal groove 33 through which the lug 29 of the feeder 27 extends upwardly for sliding movement of the feeder 27 along the magazine 23.

As shown in FIG. 2, the driver arm 15 carries a driver 34 at its front end, the driver 34 being directed downwardly toward the clinching anvil 22. There is a guide means 35 provided jointly by the bracket 31 and the magazine 23, the guide means 35 having a first guideway 36 in the bracket 31 and a second guideway 37 in a nose 38 on the front end of the magazine 23. The first and second guideways 36,37 are held in registry with each other, providing a passage through which the driver 34 is movable, the path of movement of the driver 34 being in registry with the clinching anvil 22. The staple fasteners 26 are fed one at a time by the feeder 27 across into the path of movement of the driver 34 in the guide means 35.

A pair of compression coil springs 39,39 (FIG. 3) acts between the driver arm 15 and the holder arm 16 adjacent to their front ends so as to hold them apart. A tension spring 40 (FIGS. 2 and 4) acts between the holder arm 16 and the base 11 to bias the holder arm 16 toward the base 11. The driver arm 15 is urged upwardly away from the base 11 by a pair of compression springs 41,41 (best shown in FIG. 4) acting between the driver arm 15 and the base 11.

A U-shaped arm 42 (FIG. 3) is fixed to the driver arm 15 and embraces the holder arm 16 to limit the pivotal movement of the arms 15,16 away from each other beyond a predetermined angular spacing therebetween. The angular spacing between the arms 15,16 is adjustable by turning of a screw 43 carried on the U-shaped arm 42, and projecting toward and engageable with the bottom of the holder arm 16. A similar U-shaped arm 44 is fixed to the first support 12, the arm 44 carrying a screw 45 that extends toward and is engageable with the punch arm 15 for restricting the upward angular movement of the driver arm 15 beyond an angle between the base 11 and the driver arm 15. The extent of such upward angular movement of the driver arm 15 is adjustable by the screw 45.

To the rear end portion of the holder arm 16 is secured a bracket 46, FIG. 2, to which is pivoted a lever 47 having a locking projection 48, the lever 47 being normally urged by a spring 48*a* to place the locking projection 48 in the path of movement of the magazine 23 in and along the holder arm 16. The magazine 23 has a recess 49 in which the locking projection 48 can enter, whereupon the magazine 23 can be held in position in the holder arm 16 against longitudinal outward displacement relative to the holder arm 16. When the lever 47 is pushed downwardly until the locking projection 48 is retracted clear of the recess 49, the magazine 23 can be removed from the holder arm 16 for loading of staples or for its replacement.

A resilient damper arm 50 is fixed at one end to the bracket 46, the other end of the arm 50 being engageable with the first support 12 when the holder arm 16 is pivotally moved away from the base 11. When the damper arm 50 is engaged by the first support 12, further upward movement of the holder arm 16 is resiliently restricted or dampened.

A solenoid 51 is mounted on the base 11 and is located remotely from the second support 13, the solenoid 51 having a vertical plunger 52 which is coupled by a pair of links 53 to the driver arm 15 at a position substantially centrally of the length of the driver arm 15. When the solenoid 51 is actuated, the plunger 52 is retracted from the projecting position as illustrated in FIG. 2.

It is preferable to use a small-size solenoid which is energizeable at 100 V a.c. 200 V a.c. is applied to such solenoid to obtain a plunger-drawing force which is four times greater than would be a force if 100 V a.c. were applied. With such mode of operation, it is necessary to equip the solenoid with a temperature-controlled cut-off device such as a bimetal to prevent the solenoid 51 from being excessively heated and finally damaged. With the solenoid thus minimized in size and actuatable for maximum chinching force, the machine 10 is relatively small in size and, nevertheless, can be actuated reliably.

A housing 54 is mounted on the base 11 to cover the machine parts, the housing 54 having an opening 55 in its rear wall through which the lever 47 projects. The housing 54 carries a power supply terminal 56 and a foot switch terminal 57 both for connection to the solenoid 51. A guard 58 is secured to the housing 54 and extends downwarly, the guard 58 having a semicircularly bent lower end (FIG. 1) positioned just above the anvil 22 to protect the operator's hands during operation of the machine 10.

Figure 5:
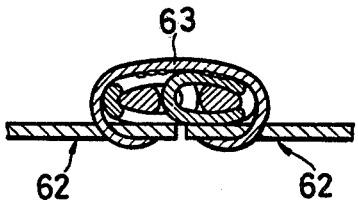
FIGS. 5 and 6 are enlarged cross-sectional views illustrating staple-like end stops attached to slide fastener stringers by the machine of the invention.

The machine 10 is especially useful for attaching staplelike end stops to slide fastener stringers which have already been sewn to garments. For such application, there may be added a slider installing device 59 supported on a horizontal rod 60 extending forwardly through an aperture 61 in the second support 13. In operation, a row of staple-like end stops is loaded into the magazine 23, which is then put in the holder arm 16 from the front end thereof until the locking projection 48 of the lever 47 is locked in the recess 49 in the magazine 23. A pair of slide fastener stringers 62,62 (FIG. 5) attached to a garment are placed together on the anvil holder 17 and are held still with a desired applying point on the stringers aligned with the anvil 22. Since there is a relatively large amount of space around the second support 13, the garment to which the slide fastener stringers 62, 62 are sewn hangs freely around the second support 13 and gives no obstruction to the following steps of applying an end stop. Then a foot switch (not shown) is depressed to actuate the solenoid 51 so as to draw the plunger 52, whereupon the driver arm 15 starts to descent toward the base 11 against the resistance of the springs 41,41. When the driver arm 15 moves downwardly, the holder arm 16 is pushed downwardly by the spring 39 acting between the arms 15,16, keeping a spacing therebetween. At this time, the tension spring 40 also helps to lower the holder arm 16. The downward movement of the holder arm 16 is prevented when the nose 38 abuts against the chain of the slide fastener stringers 62,62 on the anvil 22. The driver arm 15 still continues moving downwardly as the springs 39,41 are compressed thereby, until the driver 34 is forced downwardly through the passage in the guide means 35 to drive one staple-like end stop 63 (FIG. 5) out of the magazine 23, and to apply and clinch the end stop 63 to and about the slide fastener chain. When the end stop 63 is attached to the slide fastener stringers 62,62, the foot switch is released to de-energize the solenoid 51, whereupon the driver arm 15 immediately springs back upwardly by the combined energy stored in the springs 39 and 41 until the driver arm 15 is engaged by the screw 45 on the U-shaped arm 44 fixed to the first support 12. On the upward stroke of the driver arm 15 toward the upper limit, the screw 43 on the U-shaped arm 42 fixed to the driver arm 15 engages and raises the holder arm 16 together with the driver arm 15 to lift the guide means 35 off the slide fastener stringers 62,62 on the anvil 22.

Figure 6:
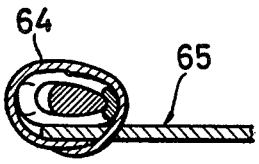

When it is required to attach a staple-like end stop 64 to a single slide fastener stringer 65 as shown in FIG. 6, the driver 34, the magazine 33, and the clinching anvil 22 are replaced with another set of driver, magazine, and clinching anvil that are suitable for applying such end stop.

Although various minor modifications may be suggested by those versed in the art, it should be understood that I wish to embody within the scope of the patent warranted hereon, all such embodiments as reasonably and properly come within the scope of my contribution to the art.

I claim as may invention

1. A staple fastener applying machine, comprising:
(a) a base having first and second supports mounted thereon and spaced from each other;
(b) a driver arm pivotally supported on said first support, said driver arm carrying a driver;
(c) a holder arm pivotally supported on said first support, said holder arm releaseably holding a removable magazine for storing therein a plurality of staple fasteners positioned in sequence along a path defined by said magazine;
(d) guide means provided jointly on said holder arm and said magazine, said driver being movable through said guide means;
(e) means on said magazine for feeding the staple fasteners one at a time into the path of movement of said driver in said guide means;
(f) a clinching anvil mounted on said second support and located in registry with said path of said driver; and
(g) powered drive means mounted on said base between said first and second supports and remotely from the second support, said drive means being connected to said driver arm for angularly moving said driver arm so as to enable said driver to move through said guide means toward said anvil.

2. A staple fastener applying machine according to claim 1, said guide means comprising a first guideway in a bracket on said holder arm and a second guideway in a nose on said magazine, said first guideway and said second guideway being in registry with each other providing a passage through which said driver is movable.

3. A staple fastener applying machine according to claim 1, said means for angularly moving said driver arm comprising a solenoid mounted on said base and having a plunger, and link means coupled between said driver arm and said plunger, said link means being connected substantially centrally of the length of said punch arm, and said solenoid being actuatable so as to retract said plunger.

4. A staple fastener applying machine according to claim 1, including an anvil holder adjustably fixed to said second support, said clinching anvil being carried on said anvil holder.

5. A staple fastener applying machine according to claim 1, said holder arm having a channel-shaped cross section and said magazine being longitudinally slidable in said holder arm, including means on said holder arm for locking said magazine in said holder arm.

6. A staple fastener applying machine according to claim 1, including first spring means acting between said driver arm and said holder arm to hold them apart, and second spring means acting between said holder arm and said base to bias said holder arm toward said base.

7. A staple fastener applying machine, comprising a base having first and second supports mounted thereon and spaced from each other; a driver arm pivotally supported on said first support, said driver arm carring a driver; a holder arm pivotally supported on said first support, said holder arm holding a removable magazine for storing therein staple fasteners; guide means provided jointly on said holder arm and said magazine, said driver being movable through said guide means; means on said magazine for feeding the staple fasteners one at a time into the path of movement of said driver in said guide means; a clinching anvil mounted on said second support and located in registry with said path of said driver; means acting between said base and said driver arm at a position remote from said second support, for angularly moving said driver arm so as to enable said driver to move through said guide means toward said anvil, said holder arm having a channel-shaped cross section and said magazine being longitudinally slidable in said holder arm; means on said holder arm for locking said magazine in said holder arm, said locking means comprising a lever having a locking projection and pivotally mounted on said holder arm, said lever being normally urged to place said locking projection in the path of movement of said magazine, and said magazine having a recess receptive of said locking projection.

8. A staple fastener applying machine, comprising a base having first and second supports mounted thereon and spaced from each other; a driver arm pivotally supported on said first support, said driver arm carrying a driver; a holder arm pivotally supported on said first support, said holder arm holding a removable magazine for storing therein staple fasteners; guide means provided jointly on said holder arm and said magazine, said driver being movable through said guide means; means on said magazine for feeding the staple fasteners one at a time into the path of movement of said driver in said guide means; a clinching anvil mounted on said second support and located in registry with said path of said driver; means acting between said base and said driver arm at a position remote from said second support, for angularly moving said driver arm so as to enable said driver to move through said guide means toward said anvil; first spring means acting between said driver arm and said holder arm to hold them apart; second spring means acting between said holder arm and said base to bias said holder arm toward said base; and third spring means acting between said driver arm and said base to hold said driver arm away from said base; means acting between said driver arm and said holder arm for limiting their pivotal movement away from each other beyond an angular spacing therebetween; and damper means acting between said holder arm and said first support for resiliently restricting the pivotal movement of said holder arm away from said base.

* * * * *